US005695329A

United States Patent [19]

Orcutt

[11] Patent Number: 5,695,329

[45] Date of Patent: Dec. 9, 1997

[54] ROTARY KILN CONSTRUCTION WITH IMPROVED INSULATION MEANS

[76] Inventor: Jeffrey W. Orcutt, 15 Marlen Dr., Robbinsville, N.J. 08691

[21] Appl. No.: 719,049

[22] Filed: Sep. 24, 1996

[51] Int. Cl.[6] ..... F27B 7/00

[52] U.S. Cl. ..... 432/103; 432/118; 432/119; 432/252; 110/246

[58] Field of Search ..... 432/103, 116, 432/117, 118, 119, 247, 248, 252; 110/246; 34/108

[56] References Cited

U.S. PATENT DOCUMENTS

| | | | |
|---|---|---|---|
| Re. 33,463 | 11/1990 | Sauder et al. . | |
| 1,920,677 | 8/1933 | Burke . | |
| 1,936,635 | 11/1933 | Lee . | |
| 2,136,734 | 11/1938 | Denman . | |
| 2,137,184 | 11/1938 | Seil . | |
| 2,186,223 | 11/1940 | Willetts | 432/248 |
| 2,230,141 | 1/1941 | Heuer . | |
| 2,230,142 | 1/1941 | Longacre . | |
| 2,321,217 | 6/1943 | Lerner . | |
| 2,633,347 | 3/1953 | Heyman . | |
| 2,635,865 | 4/1953 | Brumbaugh . | |
| 2,668,348 | 2/1954 | Hubbell . | |
| 2,678,891 | 5/1954 | Jenkins . | |
| 2,895,725 | 7/1959 | Anderson . | |
| 2,903,254 | 9/1959 | Heuer . | |
| 3,082,310 | 3/1963 | Sakamoto | 432/103 |
| 3,112,921 | 12/1963 | Wicken . | |
| 3,202,486 | 8/1965 | Versluis . | |
| 3,330,546 | 7/1967 | Bryan . | |
| 3,343,824 | 9/1967 | Schneider . | |
| 3,520,094 | 7/1970 | Deynat . | |
| 3,528,647 | 9/1970 | Hyde . | |
| 3,593,970 | 7/1971 | Seebald . | |
| 3,940,244 | 2/1976 | Sauder et al. . | |
| 4,006,693 | 2/1977 | Kunstler | 110/246 |
| 4,020,225 | 4/1977 | Fujiwara et al. . | |
| 4,049,856 | 9/1977 | Adams . | |
| 4,055,390 | 10/1977 | Young | 432/105 |
| 4,177,036 | 12/1979 | Sauder . | |
| 4,207,062 | 6/1980 | Moench et al. | 432/118 |
| 4,222,337 | 9/1980 | Christiansen . | |
| 4,248,023 | 2/1981 | Dunlap . | |
| 4,266,931 | 5/1981 | Struckmann . | |
| 4,289,479 | 9/1981 | Johnson, Jr. . | |
| 4,341,514 | 7/1982 | Shanks . | |
| 4,499,134 | 2/1985 | Whitely et al. . | |
| 4,512,738 | 4/1985 | Hartmann . | |
| 4,569,659 | 2/1986 | Olsen et al. . | |
| 4,582,742 | 4/1986 | Gilhart . | |

(List continued on next page.)

*Primary Examiner*—Henry A. Bennett
*Assistant Examiner*—Jiping Lu
*Attorney, Agent, or Firm*—Sperry, Zoda & Kane

[57] ABSTRACT

A rotary kiln apparatus including an outer kiln shell defining an interior heating chamber therein for receiving material for heating which preferably includes a rotational drive for rotating the kiln, and a plurality of refractory bricks movably positioned within the chamber in order to maintain heat within the chamber where the refractory bricks are movable and in abutment with respect to one another to accommodate thermal expansion during heating and to maintain enhanced heating within the interior heating chamber with an outer liner insulation included extending about the inside of the outer kiln shell and in abutment therewith providing thermal insulation between the outer kiln shell and the refractory brick members with a metallic intermediate liner mechanically affixed to the inner side of the outer liner insulation to extend thereover to prevent abrasion of the outer liner insulation during normal movement of the refractory brick members during kiln rotation, with mechanical affixing of the intermediate metallic liner to the softer outer liner insulation obviating the use of adhesive-type material for connecting the metallic intermediate liner to the outer liner insulation wherein the mechanical affixation provided preferably by tangs or prongs which can be punched in the metallic intermediate layer which can easily be secured extending into the softer fibrous outer liner insulation for mechanical affixation therewith.

19 Claims, 2 Drawing Sheets

U.S. PATENT DOCUMENTS

| | | | |
|---|---|---|---|
| 4,815,969 | 3/1989 | Anderson | 432/103 |
| 4,923,397 | 5/1990 | Nassetti . | |
| 4,952,147 | 8/1990 | Boyden, II et al. | 432/103 |
| 4,978,294 | 12/1990 | Uemura et al. | 432/103 |
| 5,033,959 | 7/1991 | Bernt et al. . | |
| 5,090,610 | 2/1992 | Bernt et al. . | |
| 5,122,055 | 6/1992 | Yamaguchi . | |
| 5,188,528 | 2/1993 | Rast . | |
| 5,218,615 | 6/1993 | Wieland et al. . | |
| 5,460,518 | 10/1995 | Mosci . | |

ROTARY KILN CONSTRUCTION WITH IMPROVED INSULATION MEANS

BACKGROUND OF THE INVENTION

1. Field of the Invention

The present invention deals with the field of rotary kilns and means for insulating thereof. Such rotary kilns are commonly used in industries utilizing materials under high pressure such as industries involving cement, lime, pulp and other paper industries. Such kilns are normally extremely large and on the order of 8–15 feet in diameter and can be 200–800 feet in length. Normally the kilns are of a cylindrical shape and rotate very slowly on the order of as slow as one rotation per minute. This equalizes the temperature within the kiln and keeps the material in a fluid state and constantly moving.

In this industry one of the primary problems is the prevention of warping of the outer kiln housing or shell. Due to the very high temperatures often experienced and maintained within the interior heating chamber an effective means of insulating the kiln interior from the outer skin is an important aspect. In the prior art normally there are two sets of bricks. Initially an inner refractory brick of 6–9 inches in thickness is movably positioned immediately adjacent to the material. Radially outwardly from the refractory bricks normally are located insulating bricks which are 1½–2½ inches in thickness. These insulating bricks are designed to provide a level of thermal insulation between the extremely hot refractory bricks and the external housing of the kiln. Since the kiln rotates and since the refractory bricks experience such a tremendous range of temperatures, it is necessary that clearance be provided between adjacent refractory bricks and, as such, they are mounted loosely and are normally wedge shaped within the cylindrical cross section of the housing. This constant movement of the refractory bricks during rotation of the kiln often causes excessive amounts of wear on a relatively soft insulating material which may be brick or any other material positioned immediately radially outwardly from the refractory bricks.

The present invention provides a means for replacing the insulating brick with a unique insulating construction which will provide mechanical isolation between the refractory bricks and the insulation means to prevent abrasion therebetween.

2. Description of the Prior Art

Numerous prior art designs have been conceived and patented for the purposes of providing improved insulating rotary kiln constructions. Examples of such designs are shown in U.S. Pat. No. 1,920,677 patented Aug. 1, 1933 to R. W. Burke on a "Kiln Lining"; and U.S. Pat. No. 1,936,635 patented Nov. 28, 1933 to H. S. Lee on a "Kiln Lining"; and U.S. Pat. No. 2,136,734 patented Nov. 15, 1938 to H. B. Denman and assigned to Detroit Gasket & Manufacturing Company on a "Laminated Gasket"; and U.S. Pat. No. 2,137,184 patented Nov. 15, 1938 to G. E. Seil and assigned to E. J. Lavino and Company on a "Method Of Lining Kilns And Lining Produced Thereby"; and U.S. Pat. No. 2,230,141 patented Jan. 28, 1941 to R. P. Heuer and assigned to General Refractories Company on a "Rotary Kiln Lining"; and U.S. Pat. No. 2,230,142 patented Jan. 28, 1941 to R. E. Longacre and assigned to General Refractories Company on a "Rotary Kiln Lining"; and U.S. Pat. No. 2,321,217 patented Jun. 8, 1943 to E. A. Lerner and assigned to The American Brake Shoe And Foundry Company on a "High Temperature Apparatus"; and U.S. Pat. No. 2,633,347 patented Mar. 31, 1953 to A. W. Heyman and assigned to Good Shepherd Home on a "Rotary Internally-Fired Kiln"; and U.S. Pat. No. 2,635,865 patented Apr. 21, 1953 to C. C. Brumbaugh and assigned to Diamond Alkali Company on a "Kiln Lining"; and U.S. Pat. No. 2,668,348 patented Feb. 9, 1954 to D. S. Hubbell and assigned to H. H. Robertson Company on a "Protected Metal Article"; and U.S. Pat. No. 2,678,891 patented May 18, 1954 to P. W. Jenkins and assigned to H. H. Robertson Company on "Antistick Coated, Steel Building Sheet"; and U.S. Pat. No. 2,895,725 patented Jul. 21, 1959 to F. J. Anderson and assigned to Monolith Portland Midwest Company on a "Rotary Kiln Construction"; and U.S. Pat. No. 2,903,254 patented Sep. 8, 1959 to R. P. Heuer and assigned to General Refractories Company on a "Refractory Lining For Rotary Kilns"; U.S. Pat. No. 3,112,921 patented Dec. 3, 1963 to O. M. Wicken and assigned to Harbison-Walker Refractories Company on a "Composite REfractory Member"; and U.S. Pat. No. 3,330,546 patented Jul. 11, 1967 to A. R. Bryan and assigned to Monolith Portland Cement Co. on a "Means For HOlding Kiln Brick Within A Rotary Kiln"; and U.S. Pat. No. 3,343,824 patented Sep. 26, 1967 to R. R. Schneider and assigned to Harbison-Walker Refractories Company on a "Rotary Kiln"; U.S. Pat. No. 3,520,094 patented Jul. 14, 1970 to G. Deynat and assigned to Societe des Forges et Ateliers du Creusot on a "Device For Protecting The Collars Of Rotary Kilns"; and U.S. Pat. No. 3,528,647 patented Sep. 15, 1970 to J. Hyde and assigned to Koppers Company, Inc. on an "Insulating Structure For Use Between The Steel Shell And The Internal Refractory Lining In A Metallurgical Furnace"; and U.S. Pat. No. 3,593,970 patented Jul. 20, 1971 to J. Seebald and assigned to General Refractories Company on a "Monolithic Plastic Nosering"; and U.S. Pat. No. 3,940,244 patented Feb. 24, 1976 to R. Sauder et al and assigned to Sauder Industries, Inc. on a "Ceramic Fiber Insulation Module"; and U.S. Pat. No. 4,020,225 patented Apr. 26, 1977 to H. Fijiwara et al and assigned to Maruzen Oil Co., Ltd. on a "Metal Clad Laminate Composed Of Flame Resistant Thermosetting Resin Composition"; U.S. Pat. No. 4,049,856 patented Sep. 20, 1977 to D. Adams and assigned to TBA Industrial Products Limited on "Gaskets"; and U.S. Pat. No. 4,177,036 patented Dec. 4, 1979 to R. Sauder and assigned to Sauder Industries, Inc. on a "High Temperature Industrial Furnace"; and U.S. Pat. No. 4,222,337 patented Sep. 16, 1980 to J. Christiansen and assigned to Isomax, Ingenior-OG Handelsaktieselskab on a "Furnace Lining And Method Of Manufacture"; and U.S. Pat. No. 4,248,023 patented Feb. 3, 1981 to D. Dunlap and assigned to A. P. Green Refractories Co. on an "Insulated Ceramic Fiber Refractory Module"; and U.S. Pat. No. 4,266,931 patented May 12, 1981 to H. Struckmann on an "Apparatus And Method Of Heating Particulate Material"; and U.S. Pat. No. 4,289,479 patented Sep. 15, 1981 to A. Johnson, Jr. on a "Thermally Insulated Rotary Kiln And Method Of Making Same"; and U.S. Pat. No. 4,341,514 patented Jul. 27, 1982 to D. Shanks on a "Standoff For Two Component Lining And Method Of Installation"; and U.S. Pat. No. 4,499,134 patented Feb. 12, 1985 to E. Whitely et al and assigned to Lydall, Inc. on an "Abrasion And High Temperature Resistant Composite And Method Of Making The Same"; and U.S. Pat. No. 4,512,738 patented Apr. 23, 1985 to M. Hartmann and assigned to Societe d'Etudes et de Constructions Electriques et Mecaniques Secem on "High-Temperature Kilns"; and U.S. Pat. No. 4,569,659 patented Feb. 11, 1986 to E. Olsen et al and assigned to Hoganas A. B. on a "Refractory Lining For A Furnace"; and U.S. Pat. No. 4,582,742 patented Apr. 15, 1986 to J. Gilhart on a "High-Temperature Fibrous Insulation Module"; and U.S. Pat. No. 4,923,397 patented May 8, 1990 to R. Nassetti and assigned to T. T. C. Termo Tecnica Ceramica S.P.A. on a "Flat Separation Floor Between Two Superposed Chambers In Kilns, In Particular Roller-Hearth Kilns For Ceramic Tiles"; and U.S. Pat. Reissue No. 33,463 patented Nov. 27, 1990 to R. Sauder et al and assigned to Thermal Ceramics, Inc. on a "High Temperature Insulation Module"; and U.S. Pat. No. 5,033,959 patented Jul. 23, 1991 to J. Bernt et al and assigned to J. O. Bernt & Associates Limited on a "Kiln Liner"; and U.S. Pat. No. 5,090,610 patented Feb. 25, 1992 to J. Bernt et al on a "Kiln Liner"; and U.S. Pat. No. 5,122,055 patented Jun. 16, 1992 to M. Yamaguchi and assigned to NGK Insulators, Ltd. on a "Casing For Kiln"; and U.S. Pat. No. 5,188,528 patented Feb. 23, 1993 to J. Rast on a "Method And Apparatus For Lining The Interior Surface Of A High Temperature Chamber With Heat Insulation Material"; and U.S. Pat. No. 5,218,615 patented Jun. 8, 1993 to K. Wieland et al and assigned to Didier-Werke AG on a "Furnace Lining And Lining Brick Therefor With Improved Heat Absorbing Characteristics"; and U.S. Pat. No. 5,460,518 patented Oct. 24, 1995 to R. Mosci and assigned to Quigley Company, Inc. on a "Rotary Kiln With A Cast Polygonal Lining".

SUMMARY OF THE INVENTION

The present invention provides a construction for a rotary kiln which includes a specific means for improving the manner of insulation thereof. In this apparatus an outer kiln shell is included which defines an interior heating chamber of a generally cylindrical shape therewithin. This interior heating chamber is assigned to receive material therein for heating. Also the outer kiln shell preferably defines an arcuate interior shell surface which is a natural configuration of the overall cylindrical shape.

A kiln rotation drive is included for rotatably driving the outer kiln shell and the interior heating chamber defined therein axially with respect to the generally cylindrical shape thereof. In this manner general equalization of the heating therewithin is maintained and the material therein is maintained preferably continuously moving. A plurality of refractory brick members may also be movably positioned within the interior heating chamber to facilitate the maintaining and holding of heat within the chamber. These refractory brick members are preferably movable and in abutment with respect to one another around the interior of the heating chamber. This capability of movement is important because in cooperation with spaces allows the wedge-shaped refractory bricks to expand and contract due to the great variations in temperatures experienced by these members.

An outer liner insulation is included preferably formed of a flexible fibrous insulation material which extends around the arcuate interior shell surface of the outer kiln shell. This arcuate interior surface provides a contour against which a flexible fibrous insulation material can best be positioned flush thereagainst. With this configuration preferably the insulation material will provide some element of thermal insulation of the interior heating chamber and the refractory brick members with respect to the outer kiln shell. It is important that this outer kiln shell be maintained as cool as possible since the very large kilns used in many of the industries which use rotary kilns often are positioned outside of buildings and thereby are subjected to great variations in the temperature due to weather and other normal varying external ambient conditions. It is important that the temperature of the exterior shell be maintained as low as possible in order to minimize the impact of such variations in weather conditions on the interior temperatures of the rotary kiln.

This outer liner insulation preferably defines an interior insulation liner surface therein facing inwardly toward the heating chamber. The actual insulation which forms this outer liner insulation apparatus preferably is of a material density of approximately 40 lbs. per cubic foot and is of a thickness of approximately ¼ inch, but, in any case, in the range from 0.125 inches to 0.500 inches.

A metallic intermediate liner preferably of a stainless steel or other metallic carbon based material is preferably positioned in abutment with the interior insulation liner surface of the outer liner insulation and extends preferably completely thereover. This metallic intermediate liner means is, in the most preferred configuration, mechanically affixed to the outer liner insulation adjacent the refractory brick members in such a manner as to prevent abrasion of the outer liner insulation by relative movement of the refractory brick members during rotational movement of the kiln. The metallic intermediate liner preferably includes a plurality of tanged protrusions extending therefrom which are adapted to engage the fibrous insulation material of the outer liner insulation for facilitating mechanical attachment therebetween. The tang protrusions are preferably formed by mechanically touching a plurality of engagement apertures in the metallic intermediate liner while in abutment with said outer insulation means in such a manner as to mechanically affix these two layers together. These tiny protrusions preferably include barbs extending outwardly therefrom which are designed to be embedded within the softer material of the outer liner of insulation to facilitate this mechanical attachment. In the most preferred configuration the metallic intermediate liner is of a material harder than the fibrous material of the softer outer liner insulation. As such, the metallic intermediate liner is more resistant to abrasion resulting from movement of the refractory bricks during rotation of the rotary kiln.

In the most specific preferred configuration the outer liner insulation means and the metallic intermediate liner are compressed with respect to one another by being pressed together in order to enhance securement of the barbs or tangs of the intermediate liner to a position extending into the softer and more fibrous outer liner insulation.

It is an object of the present invention to provide a rotary kiln construction having an improved insulation means wherein use in the cement, lime, pulp and paper industries is enhanced.

It is an object of the present invention to provide a rotary kiln construction having an improved insulation means wherein abrasion of the insulation means used therein is minimized.

It is an object of the present invention to provide a rotary kiln construction having an improved insulation means wherein a flexible fibrous layer of insulation is contoured against the interior arcuate surface of the outer kiln liner and is located out of abutment with respect to the refractory bricks to minimize abrasion of this softer insulation layer.

It is an object of the present invention to provide a rotary kiln construction having an improved insulation means wherein a metallic intermediate layer is mechanically affixed to the outer liner insulation to prevent abrasion thereof.

It is an object of the present invention to provide a rotary kiln construction having an improved insulation means wherein an outer liner insulation is mechanically affixed to a metallic intermediate layer which includes a plurality of prongs or barbs for mechanically affixing of the outer insulation layer with respect to the metallic intermediate layer.

It is an object of the present invention to provide a rotary kiln construction having an improved insulation means wherein conventional refractory bricks from a standard rotary kiln can be utilized.

It is an object of the present invention to provide a rotary kiln construction having an improved insulation means wherein use of adhesives or other cements which are susceptible to failure responsive to high temperatures is made unnecessary.

It is an object of the present invention to provide a rotary kiln construction having an improved insulation means wherein use of a separate insulating brick layer between the refractory bricks and the external kiln liner is made unnecessary.

It is an object of the present invention to provide a rotary kiln construction having an improved insulation means wherein warping of the external metallic kiln shell is significantly minimized.

It is an object of the present invention to provide a rotary kiln construction having an improved insulation means wherein thermal insulation between the exterior kiln liner and the heated material therein is maximized.

It is an object of the present invention to provide a rotary kiln construction having an improved insulation means wherein maintenance requirements are minimized.

It is an object of the present invention to provide a rotary kiln construction having an improved insulation means wherein additional capital cost outlay is minimized.

It is an object of the present invention to provide a rotary kiln construction having an improved insulation means wherein down time is minimized.

It is an object of the present invention to provide a rotary kiln construction having an improved insulation means wherein mechanical isolation and thermal insulation are provided by a mechanically affixed two-part layer including a metallic intermediate liner positioned mechanically affixed to an outer insulation member.

It is an object of the present invention to provide a rotary kiln construction having an improved insulation means wherein the use of refractory cement which is both high in cost and results in loss of thermal insulation characteristics is made unnecessary.

It is an object of the present invention to provide a rotary kiln construction having an improved insulation means wherein conventional fibrous insulation means can be utilized without concern for refractory abrasion thereof.

It is an object of the present invention to provide a rotary kiln construction having an improved insulation means wherein positioning of a normally large kiln of 8–15 feet in diameter outside of the weather protection of a building is made more feasible.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
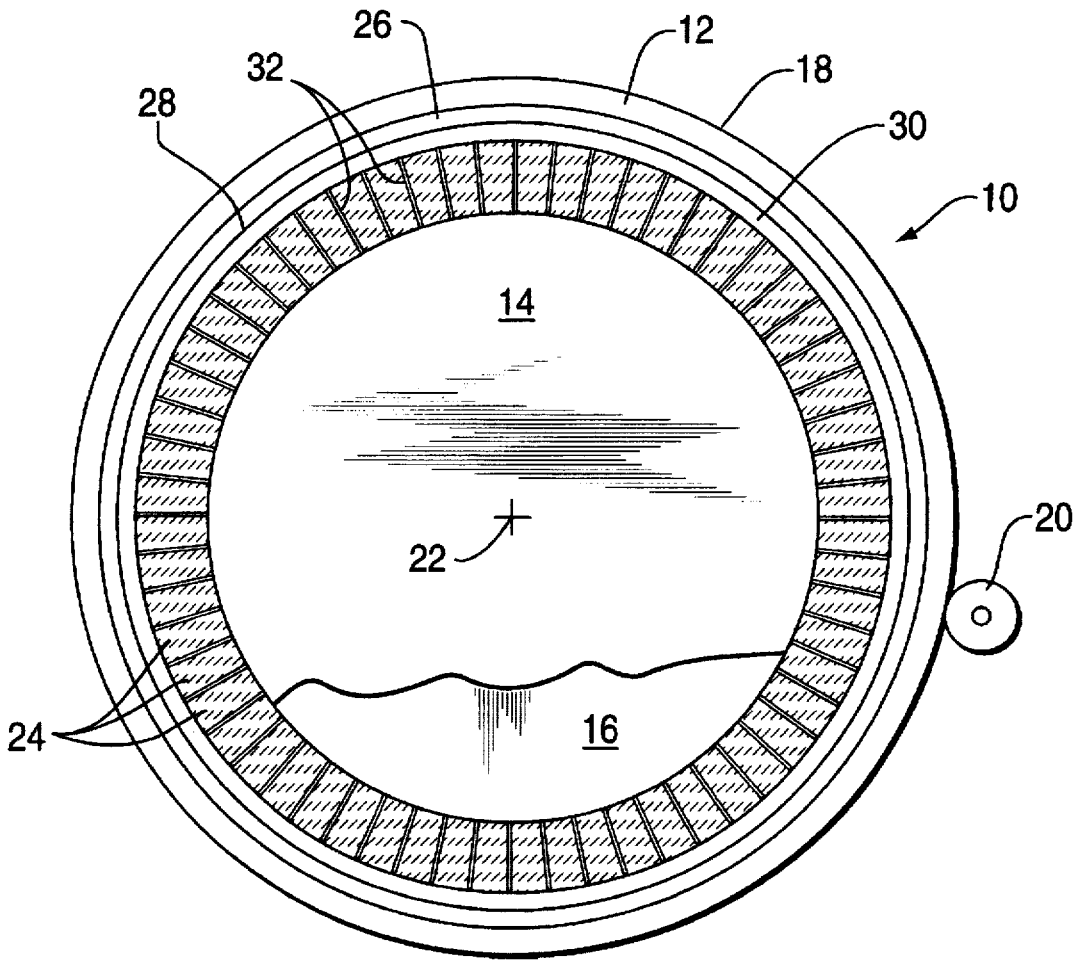
FIG. 1 is a side cross-sectional view of an embodiment of a rotary kiln made in accordance with the present invention.

The present invention provides an improved means for insulating of a rotary kiln 10. Such kilns are normally cylindrical in shape and are rotationally driven with normally particulate or somewhat fluid materials positioned therein such as cements, limes, pulps and other products used in various industries such as the paper industry. These kilns are normally extremely large in size normally as long as 8–15 feet in diameter and can be as long as 800 feet or more in order to accommodate the necessary heating. Due to the large size of such kilns 10 often they are positioned in fields adjacent the buildings where they are subjected to the external ambient environmental conditions such as extreme variations in weather. As such, it is important that the insulation between the outer kiln shell or skin 12 and the interior heating chamber 14 defined within the rotary kiln 10 be as thermally insulative as possible. The heated material 16 is normally located within the interior heating chamber 14 and is positioned against a plurality of refractory brick members 24. These refractory brick members 24 are usually wedge shaped and are loosely mounted such as to be movable with respect to one another in order to define clearances between adjacent refractory brick members 24 in order to allow for thermal expansion thereof. This refractory brick clearance 32 is an important aspect of any rotary kiln because the refractory bricks are exposed to a very wide range in temperatures and, as such, expand and contract in size to a significant extent. The refractory brick clearance 32 provides room for the expansion of these multiple refractory bricks. Also the shape of these bricks being wedge shaped allows the bricks to move slightly outwardly during time of high temperature and to move inwardly in times of relatively lower temperatures in order to still define a refractory wall within the rotary kiln 10 which is designed to hold the maximum amount of heat therein while at the same time allowing for slight movement of the refractory bricks 24 responsive to the specific temperature within the interior heating chamber 14 at a given time.

The external shell 12 of such a kiln normally includes an interior shell surface 18 which is arcuate in shape. As such, an insulation must be positioned within the interior shell surface 18 which mates with this arcuate shape while at the same time provides maximum thermal isolation between the outer kiln shell 12 and the interior heating chamber 14. In many prior art configurations insulating bricks of from 1–3 inches in thickness are used. The present invention obviates the need for use of such insulating bricks between the refractory bricks 24 and the outer kiln shell 12 by the unique insulating apparatus defined herein. One of the unique aspects of the use of the insulating bricks is in the resistance thereof to abrasion from the refractory bricks. Because the refractory bricks are movable due to the refractory brick clearance 32 defined between adjacent bricks and due to the fact that the rotary kiln 10 is designed to rotate responsive to actuation of a kiln rotation drive 20, abrasion from the refractory bricks is an important consideration. The insulating bricks over time have provided a significant amount of isolation. However, such bricks are expensive and take up a significant amount of area within the interior heating chamber 12.

As such, the present invention is designed to provide a unique configuration wherein an outer liner insulation 26 is provided preferably of a flexible fibrous material which is adapted to line the arcuate interior shell surface 28 of the kiln shell 12. Due to the flexible nature of such fibrous insulation contouring of the outer liner insulation 26 to the arcuate shape of the interior shell surface 18 is easily achieved, The outer liner insulation 26 will preferably be placed into abutment with the arcuate interior shell surface 28 and is of a flexible fibrous material insulating material having a thickness of normally less than ½ inch or between 0.125 inches and 0.500 inches. This material also preferably has a density of approximately 40 lbs, per cubic foot.

Such soft fibrous insulation has not been utilized heretofore because of the fact that this outer insulation would be very susceptible to abrasion from the movable refractory brick members 24 during operation of the kiln rotation drive 20 causing rotational movement of the rotary kiln 10. The much harder material from which the refractory brick members 24 are formed and the fact that they are loosely mounted and have interstices between defined as the refractory brick clearances 32 would tend to cause movement between them and significant abrasion against the relatively soft fibrous outer liner insulation 26. The present invention provides a unique means for preventing such isolation without taking up a great deal of interior within the interior heating chamber 14 as would the use of insulation bricks. In particular, the present invention makes use of a metallic intermediate liner means 30. Such a metallic liner preferably is formed of a stainless steel or other carbon based metallic material and is positioned immediately adjacent the interior insulation liner surface 28 of the outer liner insulation 26. The metallic intermediate liner 30 is of a material which is significantly harder than the relatively soft fibrous outer liner insulation 26 and, as such, is resistant to abrasion caused by movement of the refractory brick members 24 with respect to one another.

Another unique aspect of the present invention is the manner of causing adherence between the metallic intermediate liner 30 and the outer liner insulation 26. The use of refractory cements or other adhesives causes a measurable degradation in the insulation characteristics of the outer liner insulation 26. Also, such cements and abrasives have a strong tendency to fail when subjected to the extreme high temperatures and the extreme temperature changes experienced within the interior heating chamber 14 of a rotary kiln 10 as in the present invention. For this reason the present invention utilizes a direct mechanical means of affixation between the metallic intermediate liner means 30 and the interior insulation liner surface 28 defined on the radially innermost side of the outer liner insulation 26. This mechanical affixation means can take several forms and in this preferred embodiment is shown by the use of a plurality of tangs or barbs 36 which extend outwardly from the metallic intermediate liner 30 into the interior insulation liner surface 28 and into the fibrous material of the outer liner insulation 26. These tangs or barbs 36 tend to easily become affixed with respect to the fibrous material of the outer liner insulation 26 and, as such, maintain a firm mechanical affixing between the metallic intermediate liner 30 and the outer liner insulation 26.

In this specific preferred embodiment, the preferred manner of causing this mechanical attachment is to cause the mechanical intermediate liner 30 to be compressed against the outer liner insulation 26 while at the same time causing sheet punching of the metallic intermediate liner 30 to create a plurality of holes or apertures therein. These apertures will include a portion of the metallic layer which has formally been in the area where the aperture is now located. This torn or bent portion of the metal will cause downwardly extending barbs or tangs 36 which extend into the soft fibrous material of the outer liner insulation 26 positioned immediately below the metallic intermediate layer 30 and, as such, cause mechanical attachment between these two layers to form a single laminated piece.

Another convenient manner for causing securement of the barbs or tangs 36 in position extending into the fibrous outer liner insulation 26 is by use of pinch rollers or presses which are designed to compress the metallic intermediate liner 30 with the outer liner insulation 26 after punching of the liner 30 in such a manner as to further embed the tangs 36 thereof into the fibrous material of insulation 26.

This mechanical affixing will prevent abrasion of the relatively soft outer liner insulation 26 during rotation of the rotary kiln 10 about the cylindrical kiln axis 22. Any abrasion caused by relative movement of the refractory bricks 24 with respect to one another will be received by the metallic intermediate liner 30 which is significantly harder than the outer liner insulation 26 and, in fact, will most likely be harder than the refractory brick members 24 and, as such, will virtually eliminate any abrasion of the outer liner insulation 26. In this manner this outer liner insulation will not degrade at all during the lifetime of use of the refractory bricks 24 which is an important consideration in order to maintain the insulating characteristics of the kiln between the outer kiln shell 12 and the interior heating chamber 14. The loss of insulation between these members if a common problem which requires replacement on maintenance of such kilns in the various industries in which they are used.

An important characteristic of the present invention is in the ability to use a soft material for the outer liner insulation 26. It is this soft fibrous material which has the high insulating characteristics which are necessary in order to form insulation in such a thin layer. In this manner the total interior volume of the interior heating chamber 14 is maximized while at the same time maximizing the insulating characteristics of the rotary kiln apparatus 10.

Figure 2:
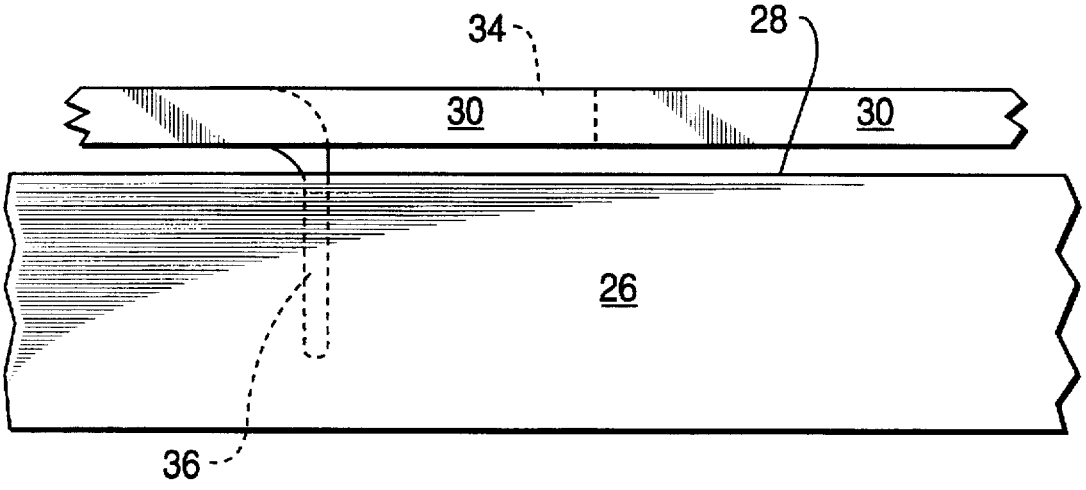
FIG. 2 is a side cross-sectional view of an embodiment of the metallic intermediate liner 30 and the outer liner insulation 26 of the present invention shown in abutment with respect to one another and mechanically affixed together.
Figure 3:
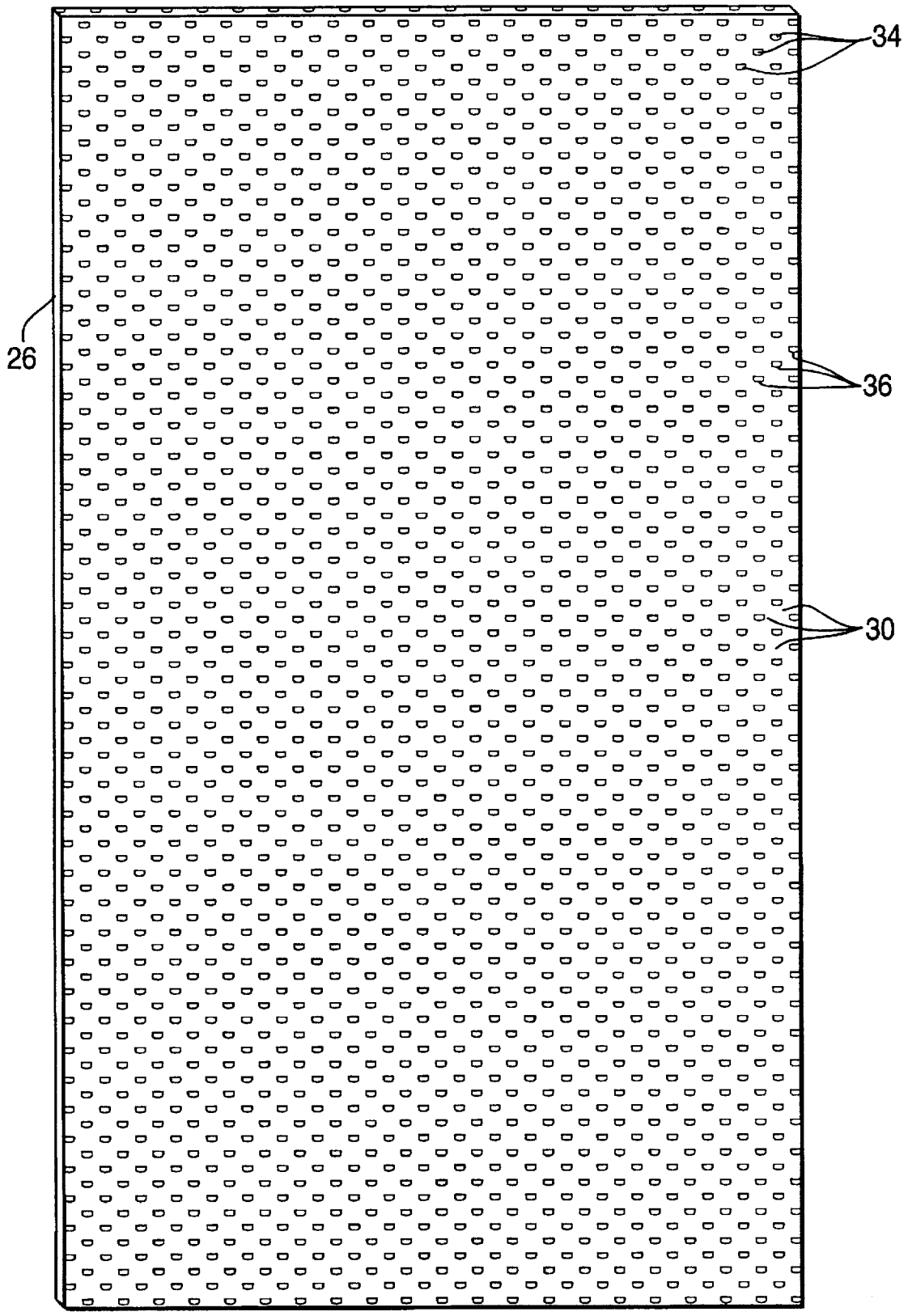
FIG. 3 is a top perspective illustration of an embodiment of the metallic intermediate liner 30 of the present invention shown positioned mechanically affixed to an embodiment of the outer liner insulation 26.

As seen best in FIG. 2 the preferred way of mechanically affixing the metallic intermediate liner 30 to the outer liner insulation 26 is by punching of apertures 34 in the metallic liner 30. Such apertures will cause protrusions or tangs 36 to extend downwardly therefrom as shown best in FIG. 2 in to engagement with the fibrous insulation 26 positioned immediately therebelow. The use of pressure rollers or presses to make this mechanical securement even more firm is also preferred. FIG. 3 shows a top perspective illustration of the metallic intermediate liner 30 showing multiple punched apertures 34 therein with tangs 36 extending downwardly therefrom into engagement with the outer liner insulation 26 therebelow.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A rotary kiln construction comprising:

A. an outer kiln shell means defining an interior heating chamber means therewithin for receiving material for heating;

B. a kiln rotational drive means for rotatably driving said outer kiln shell means and said interior heating chamber means defined therein to facilitate equalization of heating therewithin and to maintain the material therein moving;

C. a plurality of refractory brick members movably positioned within said interior heating chamber means to facilitate maintaining heat therewithin, said refractory brick members being movable and in abutment with respect to one another around said interior heating chamber means;

D. an outer liner insulation means extending around the inside of said outer kiln shell means and in abutment therewith for providing thermal insulation of said interior heating chamber means and refractory brick members with respect to said outer kiln shell means; and E. a metallic intermediate liner means positioned in abutment with said outer liner insulation means and extending thereover, said metallic intermediate liner means being mechanically affixed to said outer liner insulation means adjacent said refractory brick members to prevent abrasion of said outer liner insulation means by relative movement of said refractory brick members during rotational movement of said outer kiln shell means during operation of said kiln rotational drive means.

2. A rotary kiln construction as defined in claim 1 wherein said metallic intermediate liner means is made of stainless steel.

3. A rotary kiln construction as defined in claim 1 wherein said metallic intermediate liner means includes a plurality of tanged protrusions extending therefrom and adapted to engage said outer liner insulation means for facilitating attachment thereto to enhance mechanical securement therebetween.

4. A rotary kiln construction as defined in claim 3 wherein said tanged protrusions are formed by mechanically punching a plurality of engagement apertures in said metallic intermediate liner means while in abutment with said metallic intermediate liner means in order to mechanically affix said outer liner insulation means thereto.

5. A rotary kiln construction as defined in claim 4 wherein said outer liner insulation means is made from a fibrous thermal insulating material to facilitate mechanical affixing thereto by said metallic intermediate liner means.

6. A rotary kiln construction as defined in claim 1 wherein said metallic intermediate liner means is made of carbon steel.

7. A rotary kiln construction as defined in claim 1 wherein said outer liner insulation means is made from a fibrous thermal insulating material to facilitate mechanical affixing thereto by said metallic intermediate liner means.

8. A rotary kiln construction as defined in claim 1 wherein said outer liner insulation means includes an interior insulation liner surface thereof facing said interior heating chamber means therewithin and wherein said metallic intermediate liner means is mechanically affixed to said interior insulation liner surface of said outer liner insulation means.

9. A rotary kiln construction as defined in claim 1 wherein said outer kiln shell means defines a cylindrically-shaped interior heating chamber means.

10. A rotary kiln construction as defined in claim 9 wherein said kiln rotational drive means is adapted to drive said outer kiln shell means axially with respect to the cylindrical shape of said interior heating chamber means.

11. A rotary kiln construction as defined in claim 1 wherein said outer liner insulation means comprises an insulating material of approximately 0.125 to 0.500 inches in thickness.

12. A rotary kiln construction as defined in claim 1 wherein said outer liner insulation means is made of a flexible material to facilitate lining thereof in abutment with the interior of said outer kiln shell means.

13. A rotary kiln construction as defined in claim 12 wherein said outer kiln shell means defines an arcuate interior shell surface with said flexible material of said outer liner insulation means in direct abutment therewith.

14. A rotary kiln construction as defined in claim 1 wherein said metallic intermediate liner means is harder than said outer liner insulation means and more resistant to abrasion from movement of said refractory brick means while in abutment therewith.

15. A rotary kiln construction as defined in claim 1 wherein said outer liner insulation means comprises an insulating material having a density of approximately forty (40) pounds per cubic foot.

16. A rotary kiln construction as defined in claim 1 wherein said metallic intermediate liner means includes barb means extending outwardly therefrom and embedded into said outer liner insulation means to facilitate mechanical affixation therebetween.

17. A rotary kiln construction as defined in claim 16 wherein said outer liner insulation means and said metallic intermediate liner means are compressed by being pressed together to enhance securement of said barb means of said intermediate liner means within said outer liner insulation means.

18. A rotary kiln construction comprising:

A. an outer kiln shell means defining an interior heating chamber means therewithin for receiving material for heating, said outer kiln shell means defining an arcuate interior shell surface;

B. a kiln rotational drive means for rotatably driving said outer kiln shell means and said interior heating chamber means defined therein to facilitate equalization of heating therewithin and to maintain the material therein moving;

C. a plurality of refractory brick members movably positioned within said interior heating chamber means to facilitate maintaining heat therewithin, said refractory brick members being movable and in abutment with respect to one another around said interior heating chamber means;

D. an outer liner insulation means formed of flexible fibrous insulation material less than one inch in thickness extending around said arcuate interior shell surface of said outer kiln shell means and in abutment therewith for providing thermal insulation of said interior heating chamber means and refractory brick members with respect to said outer kiln shell means; and E. a metallic intermediate liner means positioned in abutment with said outer liner insulation means and extending thereover, said metallic intermediate liner means being mechanically affixed to said outer liner insulation means adjacent said refractory brick members to prevent abrasion of said outer liner insulation means by relative movement of said refractory brick members during rotational movement of said outer kiln shell means during operation of said kiln rotational drive means, said metallic intermediate liner means including a plurality of tanged protrusions extending therefrom and adapted to engage the fibrous insulation material of said outer liner insulation means for facilitating attachment thereto to enhance mechanical securement therebetween, said metallic intermediate liner means being of a material harder than said outer liner insulation means and more resistant to abrasion from movement of said refractory brick means while in abutment therewith.

19. A rotary kiln construction comprising:

A. an outer kiln shell means defining an interior heating chamber means of generally cylindrical shape therewithin for receiving material for heating, said outer kiln shell means defining an arcuate interior shell surface;

B. a kiln rotational drive means for rotatably driving said outer kiln shell means and said interior heating chamber means defined therein axially with respect to the generally cylindrical shape thereof to facilitate equalization of heating therewithin and to maintain the material therein moving;

C. a plurality of refractory brick members movably positioned within said interior heating chamber means to facilitate maintaining heat therewithin, said refractory brick members being movable and in abutment with respect to one another around said interior heating chamber means;

D. an outer liner insulation means formed of flexible fibrous insulation material and being between 0.125 and 0.500 inches in thickness extending around said arcuate interior shell surface of said outer kiln shell means and in abutment therewith for providing thermal insulation of said interior heating chamber means and refractory brick members with respect to said outer kiln shell means, said outer liner insulation means defining an interior insulation liner surface thereof facing said interior heating chamber means therewithin, said outer liner insulation means having a material density of approximately forty (40) pounds per cubic foot; and E. a metallic intermediate liner means of steel positioned in abutment with interior insulation liner surface of said outer liner insulation means and extending thereover, said metallic intermediate liner means being mechanically affixed to said outer liner insulation means adjacent said refractory brick members to prevent abrasion of said outer liner insulation means by relative movement of said refractory brick members during rotational movement of said outer kiln shell means during operation of said kiln rotational drive means, said metallic intermediate liner means including a plurality of tanged protrusions extending therefrom and adapted to engage the fibrous insulation material of said outer liner insulation means for facilitating attachment thereto to enhance mechanical securement therebetween, said tanged protrusions being formed by mechanically punching a plurality of engagement apertures in said metallic intermediate liner means while in abutment with said interior insulation liner surface of said outer liner insulation means in order to mechanically affix said metallic intermediate liner means thereto, said tanged protrusions including barb means extending outwardly therefrom and embedded into said outer liner insulation means to facilitate mechanical affixation therebetween, said metallic intermediate liner means being of a material harder than said outer liner insulation means and more resistant to abrasion from movement of said refractory brick means while in abutment therewith.

* * * * *